United States Patent [19]

Weismann

[11] Patent Number: 4,728,308

[45] Date of Patent: Mar. 1, 1988

[54] STERN DRIVE

[75] Inventor: Peter H. Weismann, Santa Ana, Calif.

[73] Assignee: Kaama Marine Engineering, Inc., Costa Mesa, Calif.

[21] Appl. No.: 565,526

[22] Filed: Dec. 28, 1983

Related U.S. Application Data

[63] Continuation of Ser. No. 235,572, Feb. 18, 1981, abandoned.

[51] Int. Cl.[4] ..... B63H 5/12

[52] U.S. Cl. ..... 440/57; 440/75; 440/83

[58] Field of Search ..... 440/53, 57, 59, 75, 440/78, 83, 86, 111, 112; 248/640–643; 74/413

[56] References Cited

U.S. PATENT DOCUMENTS

| | | | |
|---|---|---|---|
| 317,582 | 5/1885 | Schulze-Berge | 440/59 |
| 3,057,320 | 8/1960 | Daniels . | |
| 3,136,287 | 6/1964 | North . | |
| 3,376,842 | 4/1968 | Wynne . | |
| 3,403,655 | 10/1968 | Warburton | 440/75 |
| 3,430,603 | 3/1969 | Parish . | |
| 3,626,467 | 12/1971 | Mazziotti . | |
| 3,628,492 | 12/1971 | Baldwin | 440/75 |
| 3,734,050 | 5/1973 | Kitai et al. | 440/59 |
| 3,933,116 | 1/1976 | Adams et al. . | |
| 3,951,096 | 4/1976 | Dunlap | 440/75 |

FOREIGN PATENT DOCUMENTS

| | | | |
|---|---|---|---|
| 947053 | 7/1949 | Fed. Rep. of Germany | 440/75 |
| 59098 | 5/1980 | Japan | 440/75 |
| 6644 | of 1910 | United Kingdom | 440/112 |
| 574918 | 1/1946 | United Kingdom . | |
| 231904 | 5/1959 | United Kingdom | 440/58 |
| 1044931 | 10/1966 | United Kingdom . | |
| 1524184 | 9/1978 | United Kingdom . | |
| 2028746 | 3/1980 | United Kingdom | 440/111 |

*Primary Examiner*—Trygve M. Blix
*Assistant Examiner*—Stephen P. Avila
*Attorney, Agent, or Firm*—Lyon & Lyon

[57] ABSTRACT

A drive mechanism for power boats having an inboard motor and a stern drive propeller mounting. The device includes a gimbaled propeller shaft housing located outboard of the transom. A gear pair mounted within the propeller shaft housing provides a lower propeller shaft relative to the hull of the boat without requiring a greater propeller shaft angle relative to the hull and without requiring a lowered inboard motor position.

2 Claims, 3 Drawing Figures

STERN DRIVE

This application is a continuation of application Ser. No. 235,572, filed Feb. 18, 1981, abandoned.

BACKGROUND OF THE INVENTION

The field of the present invention is drive mechanisms for power boats. More specifically, the present invention is directed to mechanisms for transmitting power from an inboard motor of a power boat to a propeller.

A variety of mechanisms for providing power to a propeller for driving a boat have been employed, both successfully and unsuccessfully, since at least the 1800's. Two general categories of such devices employed with inboard motors have developed. Early on, fixed propeller shafts were developed which generally require a second mechanism, a rudder, for steering. More recently, devices known as inboard-outboards or stern drives have been developed which employ an articulated propeller shaft coupled with an inboard motor. These devices do not generally require additional steering mechanisms as the thrust from the propeller or propellers may be directed to effect steering much as a conventional outboard motor is employed.

Two mechanisms may be considered representative of the types of stern drives presently available. The first is illustrated in the North patent, U.S. Pat. No. 3,136,287. This device employs a horizontal input shaft, a vertical power transmission shaft, and a horizontal propeller shaft. This type of stern drive provides certain advantages of outboard motor flexibility and steering control. However, vertical shaft stern drives are typically rather inefficient because of the required gearing. The second type is represented by the Adams et al. patent, U.S. Pat. No. 3,933,116. This patent employs an inclined shaft from the inboard motor to an outboard, articulated propeller shaft. For reasons pointed out below, the engine disadvantageously must be placed low in the bilge, must be inclined and must be forward in the boat, particularly if gearing is required.

Coincident with the development of power trains for boats, improved propeller performance has also been achieved. To date, it is understood to be beneficial to run the propeller of high speed, competition type boats only about 55% submerged in the water. It is also believed to be beneficial to have the axis of the propeller angled downwardly relative to the keel line by a maximum of about two to three degrees. Finally, a factor affecting the overall performance of the propeller and the hull is to have a relatively low center of thrust. Because of these desirable factors for high speed performance, the inboard motor of the Adams et al. device must be located low, at an angle, and as far forward as possible. The North type stern drive is better able to accomplish a desired propeller orientation. However, as mentioned above, substantial efficiency is lost in the power train.

SUMMARY OF THE INVENTION

The present invention is directed to a power train for a boat having an inboard motor and a stern drive propeller. The invention includes a gear box located exterior to the hull for achieving the proper propeller attitude relative to the hull without the inefficiency of circuitous drive train lengths. This result accomplished by the present invention is achieved through the employment of an outboard gear box having parallel shafts each positioned in a generally horizontal orientation and being positioned relative to one another in a generally vertical arrangement, the lowermost of the shafts being the output shaft. A companion case dealing with the same stern drive system is disclosed in an application filed concurrently herewith to John A. Conner entitled STERN DRIVE, Ser. No. 235,573, filed Feb. 18, 1981, now U.S. Pat. No. 4,565,532, the disclosure of which is incorporated herein by reference.

The arrangements contemplated by the present invention do not achieve the appropriate orientation of the propeller shaft at the expense of inboard motor placement. Instead, the present system improves the placement of the inboard motor by allowing it to be positioned as far aft as the inboard side of the transom. It is also contemplated that the inboard position of the motor will be substantially horizontal relative to the hull and may be located up out of the bilge. In spite of this more advantageous placement of the inboard motor, the center of thrust is located low in the stern and is not tending to force the stern up and bow down.

The devices contemplated by the present invention also may enjoy other advantages. The outboard location of the gear box removes the gear box from the relatively stagnant, heated environment of the engine compartment and places it in a position to receive both water and air cooling.

Accordingly, it is an object of the present invention to provide an improved drive train for a stern drive. Other and further objects and advantages will appear hereinafter.

DETAILED DESCRIPTION OF THE PREFERRED EMBODIMENT

Figure 1:
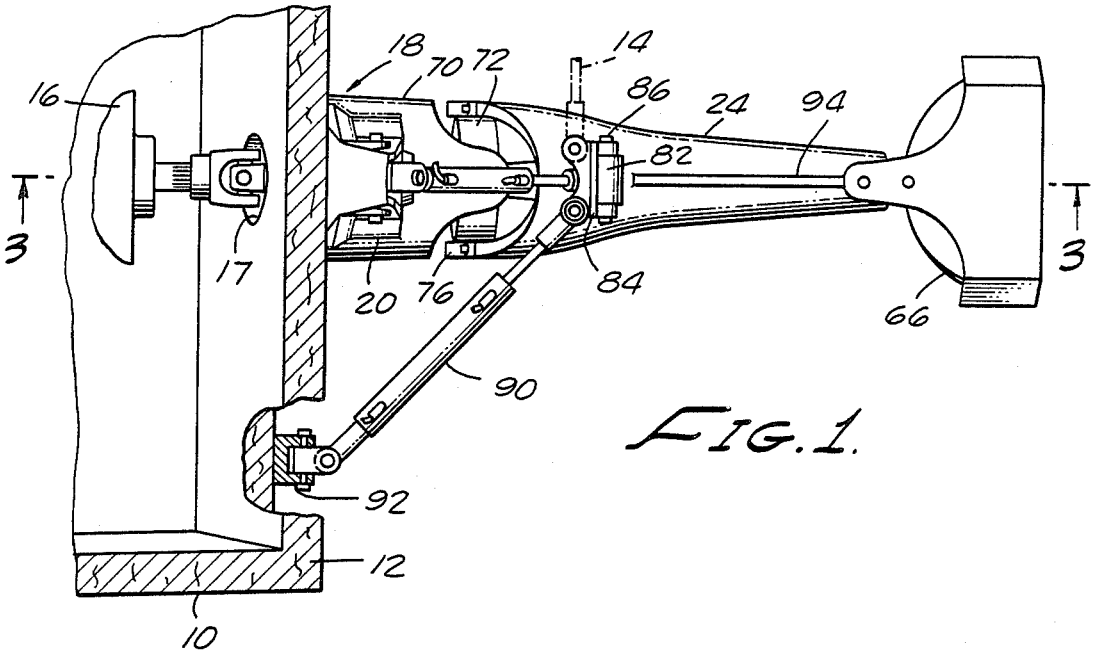
FIG. 1 is a plan view of an embodiment of the present invention shown positioned on a boat. The hull has been partially sectioned for clarity of illustration.
Figure 2:
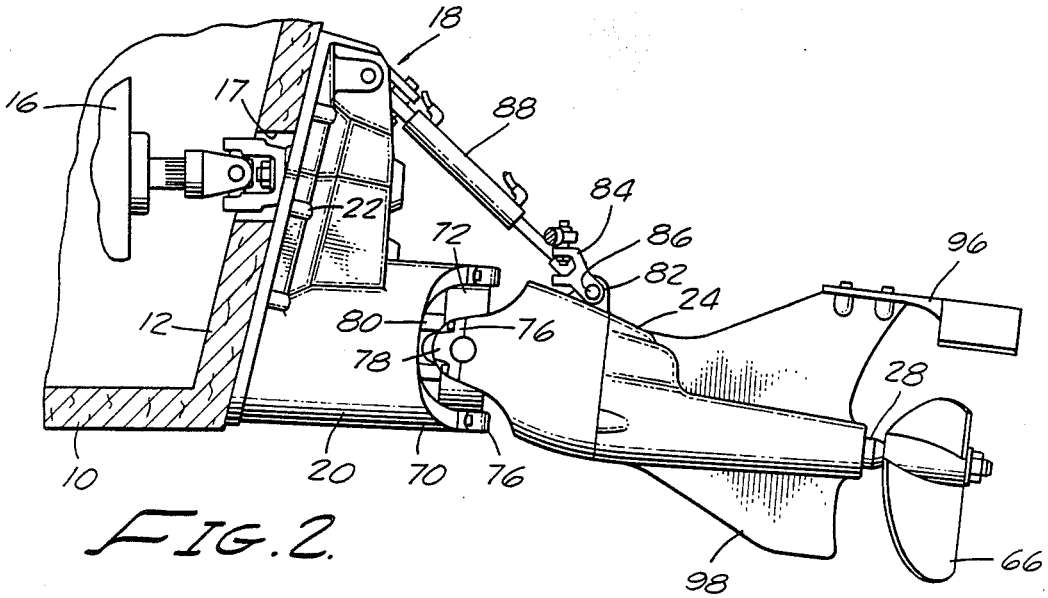
FIG. 2 is a side view of the embodiment of FIG. 1 with the boat hull sectioned along line 3—3.
Figure 3:
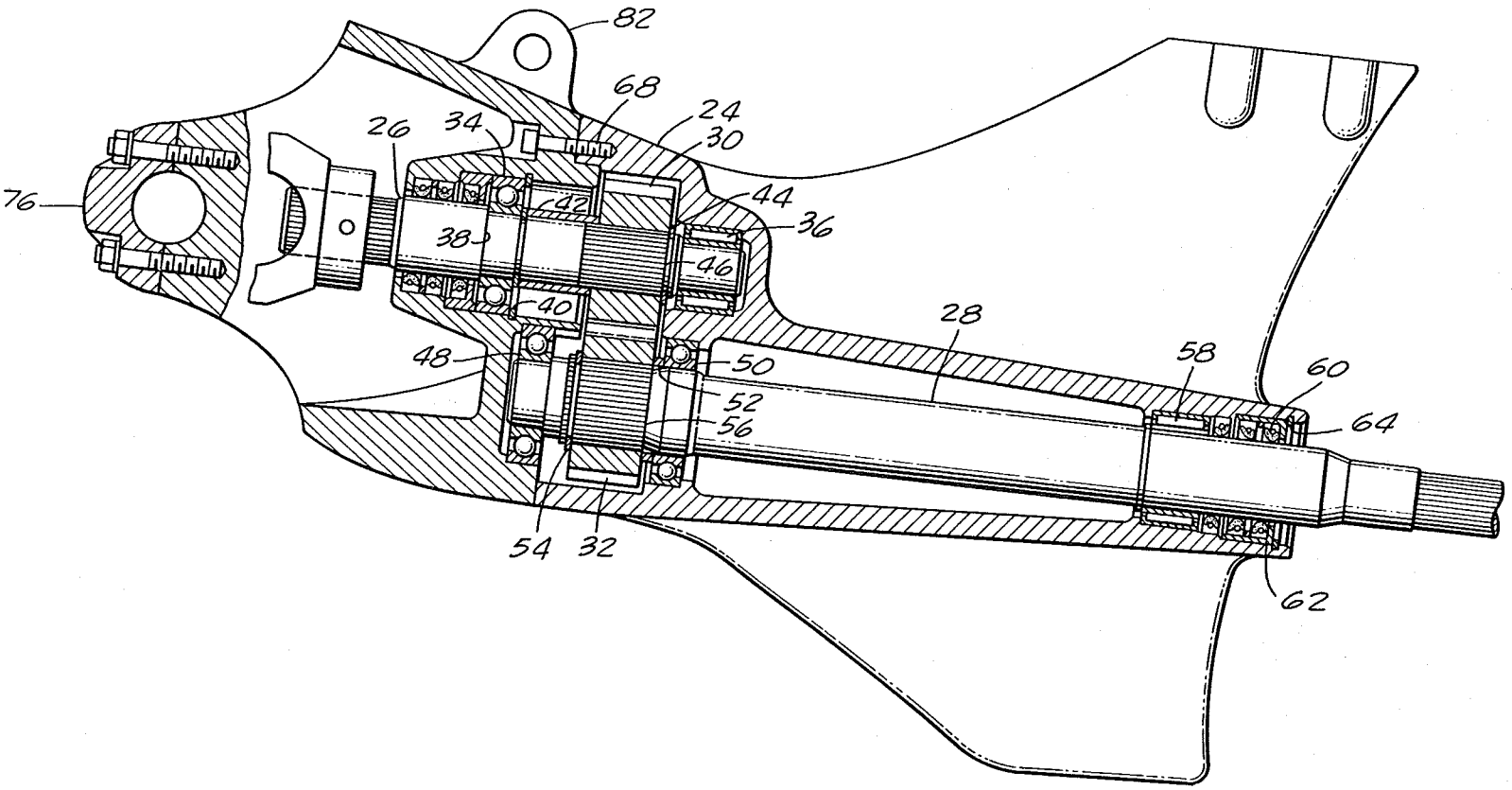
FIG. 3 is a cross-sectional elevation taken along line 3—3 of FIG. 1.

Turning in detail to the drawings, FIGS. 1 and 2 illustrate the arrangement of an embodiment of the present invention in association with a hull 10. The hull 10 includes a transom 12. The hull illustrated in FIG. 1 may represent either of two configurations. The first configuration would be that of a small boat wherein the drive is positioned centrally in the hull. In a second configuration, the portion of the hull illustrated may simply be the port side thereof. In such an event, a link, shown in phantom as 14, may be employed to control a second stern drive located on the starboard side of the hull.

Located inboard within the hull 10 is an inboard motor 16. Consistent with this preferred embodiment of the present invention, the inboard motor 16 is illustrated as being horizontally disposed relative to the hull 10 and positioned well out of the bilge. A hole 17 provides access between the motor and the stern drive.

A gear box, generally designated 18, is securely positioned to the outboard side of the transom 12. The gear box 18 includes a gear box housing 20 which is generally configured in a functional manner to enclose the drive train and to provide structural support for the articulated propeller shaft housing. The gear box 18 is held to the transom 12 by conventional means such as bolts. The bolts are distributed about the gear box housing 20 for optimum support and sealing with the transom 12. Where necessary, such as at location 22, clearance is made for facile placement of the bolts. The housing 20 generally includes a flange 24 which receives the fastening means.

Located aft of the gearbox 18 is a propeller shaft housing 24. The propeller shaft housing 24 includes an input shaft 26 and an output shaft 28. Together the input shaft 26 and the output shaft 28 combine to form a propeller shaft assembly. A gear pair consisting of gear wheels 30 and 32 couple the propeller shafts 26 and 28 together. The input propeller shaft 26 is mounted at a first end by a ball bearing 34 and at a second end by a roller bearing 36. The ball bearing 34 is retained by a shoulder 38 and a split ring retainer 40. A spacer 42 and another split ring retainer 44 retain the gear wheel 30 in position. The gear wheel 30 is caused to rotate with the shaft 26 by means of a coupling with splines 46.

The output propeller shaft 28 is rotatably mounted in the propeller shaft housing 24 by means of two ball bearings 48 and 50. The gear wheel 32 is held in place on the shaft 28 by means of a spacer 52 and a split ring retainer 54. Splines 56 insure coupled rotation of the gear wheel 32 with the shaft 28. At the distal end of the output propeller shaft 28, it is rotatably mounted in the propeller shaft housing 24 by a roller bearing 58. A plurality of seals 60 protect the distal end of the propeller shaft housing 24 from water intrusion. A cap 62 and a split ring retainer 64 retain the seals and bearing in position. A propeller 66 is conventionally mounted to the end of the propeller output shaft 28.

The gear pair provided by gear wheels 30 and 32 are employed in the propeller shaft housing 24 to lower the center of thrust of the stern drive without inducing further angular offset with the keel line. At the location where the gear pair is arranged, less drag is encountered than if the gearbox 18 were to be positioned such that it extended below the bottom of the transom 12. Thus, improved propeller performance is achieved with out substantially increasing the drag of the stern drive in the water.

Naturally, the propeller shaft housing 24 is configured as narrow as possible about the gear pair located therein. The propeller shaft housing 24 is split in a plane substantially normal to the axis of the propeller drive. Fasteners 68 are employed to retain the two portions of the propeller shaft housing 24 together and sealed.

The propeller shaft housing 24 is fixed to a mount 70 which, in this embodiment, is formed as an integral part of the gearbox housing 20. If no gearbox is employed, the mount 70 may be directly affixed to the transom 12. Coupled to the mount 70 is a mounting means for retaining the propeller shaft housing 24 yet allowing the housing 24 universal pivotal motion such that the propeller shaft housing 24 may be pulled up out of the water or extended down further into the water or may be pivoted laterally for steering. Appropriate portions of the mount 70 and the propeller shaft housing 24 are cut away to provide the necessary clearance for such movement. The mounting means includes in this preferred embodiment of a gimbal ring 72. Gimbal lugs are formed on each of the mount 70 and the propeller shaft housing 24 to receive gimbal pins of the gimbal ring 72. The gimbal lugs are split and include lug caps 76 on both the mount 70 and the propeller shaft housing 24.

The propeller shaft housing 24 is gimbaled to the mount 70 concentrically about a coupling means for transmitting power from the output shaft 78 to the propeller input shaft 26. This coupling means accommodates a range of colinear and non-collinear orientations of the two shafts and, in the present embodiment, is provided by a universal joint generally designated 80. The universal joint 80 is directly coupled to both the output 78 and the propeller input shaft 26 in a conventional manner.

To protect the gimbal 72 and the universal joint 80, it is contemplated that a boot (not shown) be positioned in sealed engagement with the mount 70 and extending into a similar sealed engagement with the propeller shaft housing 24. In this way, moisture can be excluded from the area of both the mounting and coupling means for the gimbaled propeller shaft. The boot, of course, requires substantial flexibility to accommodate the gimbaled motion of the propeller shaft housing 24.

Steering and attitude control mechanisms are associated with the propeller shaft housing 24 by a boss 82 on the upper side of the propeller shaft housing 24. A control bracket 84 is pivotally mounted on the boss 82 by means of a clevis and spherical joint assembly 86. To this control bracket 84 are coupled an attitude control hydraulic cylinder 88 and a steering control hydraulic cylinder 90. Also link 14 may be coupled with the control bracket 84 when a dual stern drive arrangement is employed. The steering cylinder 90 is then fixed by means of a conventional mount 92 to the transom 12. The attitude cylinder 88 is coupled to a plurality of mounting brackets 94 located on the upper portion of the gearbox housing 20. Thus, the gimbaled propeller may be controlled in all directions by conventional hydraulics.

On the propeller shaft housing 24 are fins available for further control. A dorsal fin 94 extends upwardly to a horizontal propeller guard 96. A skeg 98 extends downwardly from the main portion of the propeller shaft housing.

Thus, an improved stern drive arrangement is here disclosed.

What is claimed is:

1. A power train for a boat having a hull, a transom, and an inboard motor, comprising a propeller shaft housing;

a mount rigidly fixable to the outboard side of the transom, adjacent the bottom of the transom, said propeller shaft housing being mounted to said mount to provide universal pivotal motion of said propeller shaft housing relative to said mount;

a steering control mechanism coupled with said propeller shaft housing for steering said propeller shaft housing relative to the hull;

an input propeller shaft in said propeller shaft housing and extending toward said mount for power coupling through said mount with the inboard motor;

an output propeller shaft mounted in said propeller shaft housing and extending from said housing at a distal end thereof, said output propeller shaft being located below said input propeller shaft and generally extendable to a surface drive position with said output propeller shaft substantially in a direct line with the bottom of the hull; and a gear pair coupled with said input and said output propeller shafts and located within said propeller shaft housing.

2. A power train for a boat having a hull, a transom, and an inboard motor, comprising a propeller shaft housing;

a mount rigidly fixable to the outboard side of the transom adjacent the bottom of the transom, said propeller shaft housing being mounted to said mount to provide universal pivotal motion of said propeller shaft housing relative to said mount;

a steering control mechanism coupled with said propeller shaft housing for steering said propeller shaft housing relative to the hull;

an input propeller shaft in said propeller shaft housing and extending toward said mount for power coupling through said mount with the inboard motor;

an output propeller shaft mounted in said propeller shaft housing and extending from said housing at a distal end thereof, said output propeller shaft being located below and substantially parallel to said input propeller shaft and generally extendable to a surface drive position with said output propeller shaft substantially in a direct line with the bottom of the hull; and a gear train for said input and said output propeller shafts and located within said propeller shaft housing, including gears all rotatably mounted about axes parallel to said input propeller shaft.

* * * * *